US010079084B1

(12) United States Patent
Li

(10) Patent No.: US 10,079,084 B1
(45) Date of Patent: Sep. 18, 2018

(54) FINE-GRAINED ND—FE—B MAGNETS HAVING HIGH COERCIVITY AND ENERGY DENSITY

(71) Applicant: Ford Global Technologies, LLC, Dearborn, MI (US)

(72) Inventor: Wanfeng Li, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 446 days.

(21) Appl. No.: 14/534,758

(22) Filed: Nov. 6, 2014

(51) Int. Cl.
*B22F 3/12* (2006.01)
*H01F 1/057* (2006.01)
*B22F 3/24* (2006.01)

(52) U.S. Cl.
CPC ..... *H01F 1/0577* (2013.01); *B22F 3/24* (2013.01)

(58) Field of Classification Search
None
See application file for complete search history.

(56) References Cited

U.S. PATENT DOCUMENTS 6,746,545 B2 6/2004 Tamura et al.
8,846,136 B2 9/2014 Shoji et al.
2008/0317620 A1 12/2008 Suzuki et al.
2010/0003156 A1* 1/2010 Suzuki ..... B22F 1/025 419/10
2011/0057756 A1 3/2011 Marinescu et al.
2012/0299675 A1* 11/2012 Honkura ..... C22C 1/0441 335/302
2013/0323111 A1 12/2013 Miyamoto et al.
2015/0279529 A1 10/2015 Ichigozaki et al.
2016/0027564 A1* 1/2016 Une ..... B22F 1/0044 419/30
2016/0086704 A1* 3/2016 Namkung ..... H01F 1/0576 335/302

FOREIGN PATENT DOCUMENTS

CN 103098155 A 5/2013
CN 103493159 A 1/2014
(Continued)

OTHER PUBLICATIONS

Sepehri-Amin (Scripta Materialia, 2010, vol. 63, p. 1124-1127).*
(Continued)

*Primary Examiner* — Xiaowei Su
(74) *Attorney, Agent, or Firm* — Brooks Kushman P.C.

(57) ABSTRACT

Magnets and methods of making the magnets are disclosed. The magnets may have high coercivity and may be suitable for high temperature applications. The magnet may include a plurality of grains of a Nd—Fe—B alloy having a mean grain size of 100 to 500 nm. The magnet may also comprise a non-magnetic low melting point (LMP) alloy, which may include a rare earth element and one or more of Cu, Ga, and Al. The magnets may be formed from a Nd—Fe—B alloy powder produced using HDDR and jet milling, or other pulverization process. The powder may have a refined grain size and a small particle size and particle size distribution. The LMP alloy may be mixed with a powder of the Nd—Fe—B alloy or it may be diffused into a consolidated Nd—Fe—B bulk magnet. The LMP alloy may be concentrated at the grain boundaries of the bulk magnet.

7 Claims, 2 Drawing Sheets

(56) References Cited

FOREIGN PATENT DOCUMENTS

| | | | |
|---|---|---|---|
| CN | 104112580 | A | 10/2014 |
| WO | 2014069181 | A1 | 5/2014 |

OTHER PUBLICATIONS

Li, W.F., "Effect of post-sinter annealing on the coercivity and microstructure of Nd—Fe—B permanent magnets", vol. 57, Issue 5, Mar. 2009, pp. 1337-1346 (Abstract Only).
Akiya, T., "High-coercivity hot-deformed Nd—Fe—B permanent magnets processed by Nd—Cu eutectic diffusion under expansion constraint", vol. 81, Jun. 15, 2014, pp. 48-51 (Abstract Only).
Tang, Xin, et al, "Enhanced Texture in Die-Upset Nanocomposite Magnets by Nd—Cu Grain Boundary Diffusion," Applied Physics Letters, vol. 102, Issue 7, id. 072409 (5 pages) (2013).
First Office Action for Chinese Patent Application No. 201510726310.6, dated Jul. 18, 2018, 10 Pages.

* cited by examiner

FINE-GRAINED ND—FE—B MAGNETS HAVING HIGH COERCIVITY AND ENERGY DENSITY

TECHNICAL FIELD

The present disclosure relates to fine-grained Nd—Fe—B magnets having high coercivity and energy density, for example, for use in electric vehicle applications.

BACKGROUND

Neodymium-Iron-Boron (Nd—Fe—B) alloy magnets have generally been the permanent magnets with the highest available performance. Accordingly, Nd—Fe—B magnets are used in a number of applications, such as MRI and computer-related applications. Demand for Nd—Fe—B magnets has been continuously increasing, in particular from green energy applications, such as electric vehicles and gearless wind turbines. For these applications, the magnets may need to work at high temperatures, which is currently a weak point of Nd—Fe—B magnets. Nd—Fe—B magnets have a low Curie temperature (~312° C.) compared with other permanent magnets, such as Alnico and Sm—Co magnets. The magnetic performance of Nd—Fe—B magnets may decay rapidly with increasing temperature. Therefore, for high temperature applications, the remanence and coercivity may be important properties.

For anisotropic Nd—Fe—B magnets, which are the magnets used for many high-performance applications, remanence can be enhanced by improving the alignment of the hard magnetic $Nd_2Fe_{14}B$ grains. There are different approaches to increase the coercivity of Nd—Fe—B magnets. One method is to substitute Dysprosium (Dy) or Terbium (Tb) for Nd in the magnets, since $(Dy,Tb)_2Fe_{14}B$ has a much higher anisotropy field than $Nd_2Fe_{14}B$. However, this coercivity enhancement may come at the expense of decreased saturation magnetization. To make the magnet work stably at 200° C., 10 wt. % Dy may be added into the magnet, which causes a significant decrease in remanence and $(BH)_{max}$. In addition, Dy and Tb are much less abundant in the earth compared to the light rare earth elements, such as Nd and Pr. The heavy rare earth (HRE) elements (e.g., Dy and Tb) are the least abundant of the rare earth (RE) elements.

Recently, alternative approaches have been developed to decrease the use of Dy/Tb in sintered Nd—Fe—B magnets for high temperature applications, including the double alloy method and the grain boundary diffusion method. The aim of both methods is to form a shell of heavy rare earth rich $R_2Fe_{14}B$ phase on the surface of the hard magnetic grains. The increased anisotropy field in the shell prevents the nucleation of reversed domains when the magnet is exposed to an external demagnetizing field. Despite the fact that the Dy/Tb content can be decreased by nearly 50%, Dy or Tb is still needed in these magnets.

SUMMARY

In at least one embodiment, a magnet is provided including a plurality of grains of a Nd—Fe—B alloy having a mean grain size of 100 to 500 nm and a non-magnetic low melting point (LMP) alloy including a rare earth element and one or more of Cu, Ga, and Al.

The LMP alloy may be substantially a binary, ternary, or quaternary alloy of a rare-earth element and one or more of Cu, Ga, and Al. In one embodiment, the magnet comprises from 0.1 wt. % to 10 wt. % of the LMP alloy. The rare earth element in the LMP alloy may be Nd or Pr. In one embodiment, an intergranular composition of the magnet has a higher concentration of the LMP alloy than an intragranular composition of the magnet. The plurality of grains of the Nd—Fe—B alloy may have a mean grain size of 200 to 400 nm.

In at least one embodiment, a method of forming a magnet is provided. The method may include preparing a magnetic powder of a Nd—Fe—B alloy having a mean grain size of 100 to 500 nm, pulverizing the magnetic powder to a mean particle size of 100 nm to 10 μm, mixing the magnetic powder with a non-magnetic low melting point (LMP) alloy powder to form a powder mixture, and consolidating the powder mixture to form a bulk magnet.

In one embodiment, the preparing step includes a hydrogenation disproportionation desorption and recombination (HDDR) process and the pulverizing step includes jet milling. The LMP alloy may include a rare earth element and one or more of Cu, Ga, and Al. In one embodiment, the LMP alloy is substantially a binary, ternary, or quaternary alloy of a rare-earth element and one or more of Cu, Ga, and Al. The pulverizing step may produce a magnetic powder having a substantially homogeneous particle size. In one embodiment, the consolidating step includes spark plasma sintering, hot compaction, or microwave sintering. The method may also include a heat treatment after the consolidating step, the heat treatment having a temperature of 450° C. to 700° C.

In at least one embodiment, a method of forming a magnet is provided. The method may include preparing a magnetic powder of a Nd—Fe—B alloy having a mean grain size of 100 to 500 nm, pulverizing the magnetic powder to a mean particle size of 100 nm to 10 μm, consolidating the magnetic powder to form a bulk magnet, and diffusing a non-magnetic low melting point (LMP) alloy into the bulk magnet.

In one embodiment, the preparing step includes a hydrogenation disproportionation desorption and recombination (HDDR) process and the pulverizing step includes jet milling. The LMP alloy may include a rare earth element and one or more of Cu, Ga, and Al. The diffusing step may include applying the LMP alloy to the bulk magnet and heat treating the LMP alloy and the bulk magnet. Heat treating the LMP alloy and the bulk magnet may include a heat treatment having a temperature of 450° C. to 700° C. In one embodiment, the diffusing step includes diffusing the non-magnetic LMP alloy into the bulk magnet such that an intergranular composition of the bulk magnet has a higher concentration of the LMP alloy than an intragranular composition of the bulk magnet.

DETAILED DESCRIPTION

Figure 1:
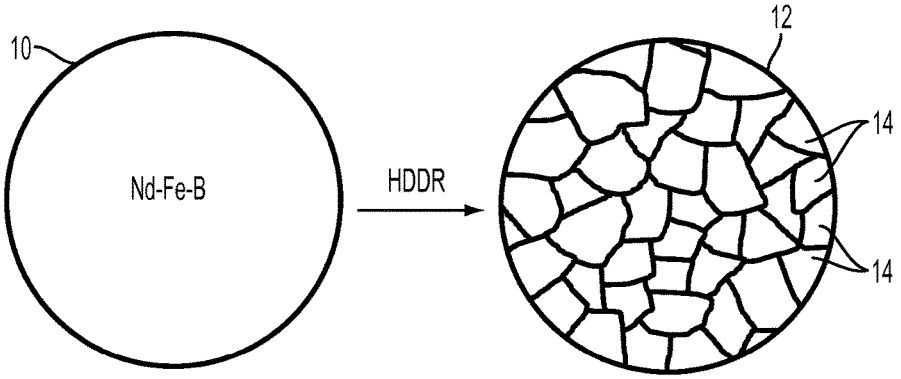
FIG. 1 is a schematic of grain size reduction during a hydrogenation disproportionation desorption and recombination (HDDR) process.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As described in the background, increasing coercivity at high temperatures is still a major hurdle for Nd—Fe—B alloy magnets. It has been discovered that another approach to increasing the coercivity is to decrease the grain size. For example, for sintered magnets, a coercivity of 20 kOe may be achieved without Dy/Tb. The average grain size of such a magnet is about 1 μm. Although the coercivity is significantly higher, it may still not be sufficient to make the magnet work stably at high temperatures for some applications, such as electric vehicles and wind turbines. In addition, for the conventional sintered magnets, it is difficult to decrease the grain size further, due to issues such as the difficulty in preparing finer powders and preventing grain growth during sintering.

It has also been discovered that the addition of low melting point (LMP) alloys may increase the coercivity of Nd—Fe—B magnets. Non-limiting examples of LMP alloys may include R—Cu, R—Ga, and R—Al, wherein R is a rare earth element such as neodymium (Nd) or praseodymium (Pr). In the present disclosure, permanent magnets having both refined grain sizes (e.g., less than one micron), enhanced texture, and the addition of LMP alloys are disclosed, as well as methods of forming the magnets. Accordingly, the disclosed magnets may have improved coercivity and remanence at high temperatures, making them more suitable for applications such as electric vehicles and wind turbines.

As described above, it is difficult to produce magnets having grain sizes less than about 1 μm. It is difficult to produce magnetic powders or particles having a size that small or smaller and, even if they are produced, it is difficult to prevent grain growth during sintering. In at least one embodiment, Nd—Fe—B alloy particles having highly refined grain sizes (e.g., under 1 μm) are prepared using a hydrogenation disproportionation desorption and recombination (HDDR) process. The fundamentals of the HDDR process are known to one of ordinary skill in the art and will not be explained in detail. In general, the HDDR process includes a series of heat treatments in a hydrogen atmosphere and under vacuum. During the process, a bulk Nd—Fe—B alloy, such as $Nd_2Fe_{14}B$, is heated in a hydrogen atmosphere to perform the hydrogenation process. During the disproportionation step, the alloy segregates into $NdH_2$, Fe, and $Fe_2B$ phases. Once a vacuum atmosphere is introduced, the desorption of hydrogen occurs and then, in the recombination step, the $Nd_2Fe_{14}B$ phase is reformed, normally with a finer grain size than the alloy started with.

A schematic of the result of the HDDR process is shown in FIG. 1, which shows a particle 10 having a large grain size transitioning to a particle 12 having a plurality of smaller grains 14. In at least one embodiment, the grain size (e.g., mean grain size) of the formed powder 12 is from 100 to 500 nm, or any sub-range therein. For example, the grain size may be from 150 to 450 nm or 200 to 400 nm. By controlling the processing parameters of the HDDR process, such as the partial pressure of hydrogen during the disproportionation step, anisotropic Nd—Fe—B powders can be produced. Anisotropic powders can significantly increase the remanence, and therefore the energy product, of the resulting magnets.

Figure 2:
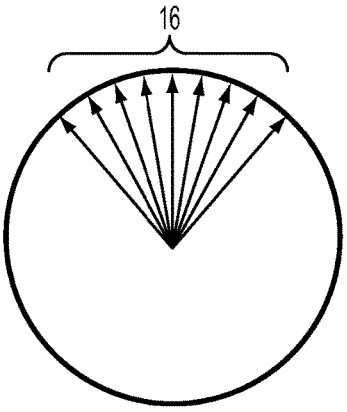
FIG. 2 is a schematic of a magnetic orientation distribution in a magnetic powder after an HDDR process.
Figure 3:
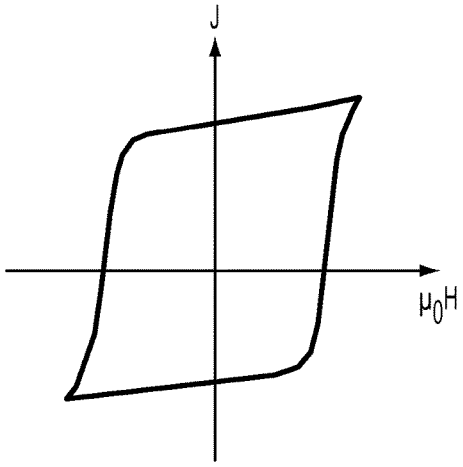
FIG. 3 is a schematic hysteresis loop of a magnet formed from as-prepared HDDR powder.

However, Nd—Fe—B alloy powders produced by the HDDR process have several properties that may be problematic for a permanent magnet. While the particles may be anisotropic, they are not perfectly aligned, as schematically shown by the orientation distribution 16 in FIG. 2. Also, while the mean grain size of the particles may be greatly reduced, the particles themselves are generally quite large, for example, several hundred micrometers (as shown in FIG. 1). Due to the large particle size and misorientation between different grains in a single particle, the grains are oriented in a wide range of angles in each individual particle. As a result, magnets formed from as-produced powder generated by the HDDR process may have a demagnetization curve that looks similar to FIG. 3. The demagnetization curve may not be "square," which indicates poor anisotropy, remanence, and maximum energy product ((BH)max).

Figure 4:
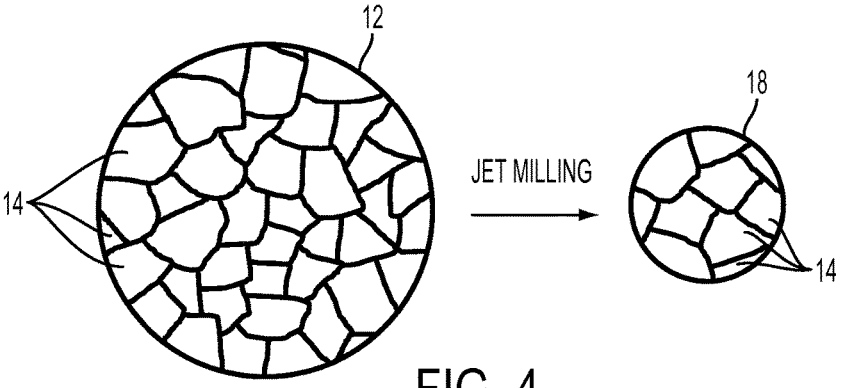
FIG. 4 is a schematic of particle size reduction during a jet milling process.

It has been discovered that the anisotropy and remanence of magnets prepared with HDDR-generated powders can be significantly improved (e.g., the demagnetization curve can be made more square) by reducing the particle size and narrowing the particle size distribution. In at least one embodiment, the particle size may be reduced using a pulverization technique, such as jet milling. Other pulverizations methods may also be used, for example, ball milling with subsequent filtering to achieve a certain particle size and/or size distribution. Jet milling includes the use of compressed air or other gases to cause particles to impact one another at high velocity and under extreme turbulence. The particles 12 are reduced to smaller and smaller particles 18 due to interparticular impact and attrition (e.g., as shown in FIG. 4). The particle size may be reduced significantly by controlling and optimizing the parameters of the jet milling process, such as the pressure of the grinding nozzle and pushing nozzle. Since the size reduction is caused by particle-to-particle impact, there is no contamination of the particles from other substances. In at least one embodiment, the Nd—Fe—B alloy powder may have a mean or average particle size of 100 nm to 10 μm, or any sub-range therein, following the jet milling process. For example, the powder may have a mean particle size of 100 nm to 5 μm, 100 nm to 3 μm, 200 nm to 3 μm, 200 to 1 μm, or 100 nm to 500 nm.

While reducing the particle size can improve the anisotropy and remanence of HDDR magnets, it may not be advantageous to reduce the particle size as far as possible. Pulverization techniques, such as jet milling, may cause damage to the surface of the particles, which may reduce coercivity. Reducing particle size to a high degree requires either longer milling time or higher milling energy, which may result in increased surface damage (and therefore lower coercivity). This damage may require that a subsequent heat treatment do more to repair the damage. Accordingly, a balance between low and very-low particle size may be beneficial. The jet milling process may result in particles that include a single grain or several grains (e.g., up to 5 grains). In one embodiment, the particles may have an average of up to 5 or up to 10 grains per particle. In another embodiment, a majority or substantially all (e.g., at least 95%) of the particles may include only a single grain.

Figure 5:
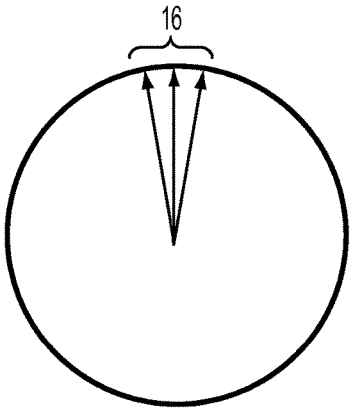
FIG. 5 is a schematic of a magnetic orientation distribution in a HDDR powder after jet milling.
Figure 6:
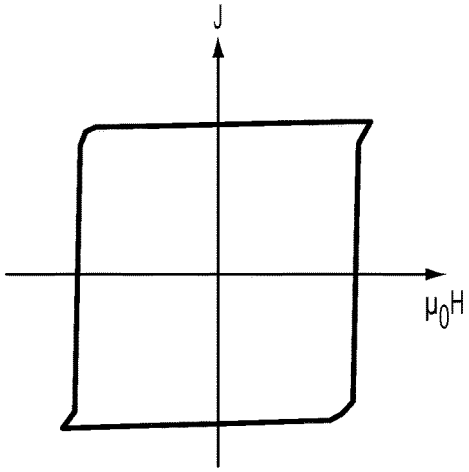
FIG. 6 is a schematic hysteresis loop of a magnet formed from HDDR powder that was subsequently jet-milled.

In addition to reducing the particle size, jet milling may also narrow the size distribution of the powder. This is due, at least in part, to the fact that larger particles have higher momentum. Therefore, collisions between large particles produce substantial size reductions compared to impacts between smaller particles. In embodiments where other pulverization techniques are used, screening may be used to achieve a narrow size distribution. Accordingly, in at least one embodiment, the Nd—Fe—B alloy powder may have a substantially homogeneous particle size (e.g., ±50% of the mean particle size). A narrowing of the size distribution also narrows the magnetic orientation distribution 16, as shown in FIG. 5 (compared to FIG. 2). To avoid oxidation, the pulverization technique (e.g., jet milling) may be performed in a protective gas environment, such as nitrogen or an inert gas. With reference to FIG. 6, a schematic hysteresis loop is shown for a magnet formed from magnetic powder processed according to the above methods (e.g., HDDR and jet milling) and aligned in a strong magnetic field, for example, 5 T. In general, the magnetic field strength required to align smaller particles may be greater than the field strength required to align larger particles. Accordingly, the field strength applied may be adjusted based on factors such as particle size or the degree of alignment desired/required. As shown, the hysteresis loop is very square, particularly compared to the loop of FIG. 3, indicating high anisotropy, coercivity, and remanence.

As described above, it has been found that decreased grain size can increase the coercivity of a magnet. While the HDDR process produces very fine grain sizes, the coercivity of the powders produced is not as high as would be expected. Using microstructural analysis, it has been discovered that the lower-than-expected coercivity of the HDDR powder is due, at least in part, to higher iron content in the grain boundaries compared to conventional sintered Nd—Fe—B magnets. In order to adjust and improve the composition of the grain boundaries in the disclosed magnets, a low melting point (LMP) alloy may be added to the magnet composition. In at least one embodiment, the melting point of the LMP alloy is from 400° C. to 600° C., or any sub-range therein. The melting point of the LMP alloy may be below the melting point of the Nd-rich phase in Nd—Fe—B magnets but high enough to remain stable for the magnet to work at high temperatures, for example, 180° C. for electric vehicle applications. It has been discovered that the addition of LMP alloys may increase the coercivity of Nd—Fe—B magnets, for example, by diffusing into the grain boundaries during the consolidation and/or annealing process. Without being held to any particular theory, it is believed that the LMP alloy increases the coercivity of the magnets by diffusing into the grain boundaries and diluting the iron (Fe) content in the grain boundaries. In addition, due to their low melting point, the LMP alloy may help to release the strains near the surface of the $Nd_2Fe_{14}B$ grains. Both of these mechanisms may improve the coercivity.

The LMP alloy may be an alloy of a rare earth element and one or more transition metal or post-transition metal, such as Cu, Ga, or Al. Non-limiting examples of LMP alloys may include R—Cu, R—Ga, and R—Al, wherein R is a rare earth element such as neodymium (Nd) or praseodymium (Pr). The LMP alloy may be described as having a formula of R-M, wherein R is a rare earth element and M is a transition metal or post-transition metal or an alloy thereof. The LMP alloy may be a binary alloy, including substantially only a rare earth element and one other element (e.g., Cu, Ga, or Al). The LMP alloy may also include a rare earth element and a combination of Cu, Ga, and Al (e.g., a ternary or quaternary alloy). The rare earth element may also be an alloy of rare earth elements, such as Nd and Pr. In one embodiment, the LMP alloy is non-magnetic. The LMP alloy may also be generally non-reactive with the main $Nd_2Fe_{14}B$ grains in the magnet. In one embodiment, the LMP alloy may include NdCu. NdCu may be formed by a reaction between Nd (~66 at. %) and Cu (~33 at. %) to form NdCu and Nd at 520° C. The Nd for this reaction may be supplied in the LMP alloy (e.g., powder) or by the magnet itself, since the magnet has an Nd-rich phase in the grain boundaries. In another embodiment, the composition of the LMP alloy may be between NdCu and $Nd_2Cu$. These rare earth-based alloys have been found to be helpful in increasing the coercivity of sintered magnets, and the melting point of these alloys are very well suited for Nd—Fe—B magnets. Whether the LMP alloy is binary, ternary or even quaternary, they may work in a similar manner, because they have similar structures and properties.

A powder of the LMP alloy may be produced by any suitable process. In one embodiment, a powder of the LMP alloy is produced by arc melting followed by ball milling. The ball milling process may include cryo-milling, which may be considered a type of ball milling, but generally is more effective at decreasing particle size to get a fine powder. The particle size of the LMP alloy powder may range from nanometer scale to micron scale. For example, the powder may have a mean particle size of tens of nanometers to hundreds of microns. Since the LMP alloy may be non-magnetic, reducing the amount of LMP alloy may provide the magnet with a higher magnetization. Smaller particle sizes may allow the LMP alloy to be present in the grain boundaries of the magnet, while reducing the overall LMP alloy content of the magnet. Accordingly, in at least one embodiment, the LMP alloy particles may be nanoparticles (e.g., under 1 μm). For example, the LMP alloy powder may have a mean particle size of 10 nm to 10 μm, or any sub-range therein, such as 10 nm to 5 μm, 10 nm to 1 μm, 10 nm to 900 nm, 50 nm to 750 nm, or 100 nm to 500 nm.

Figure 7:
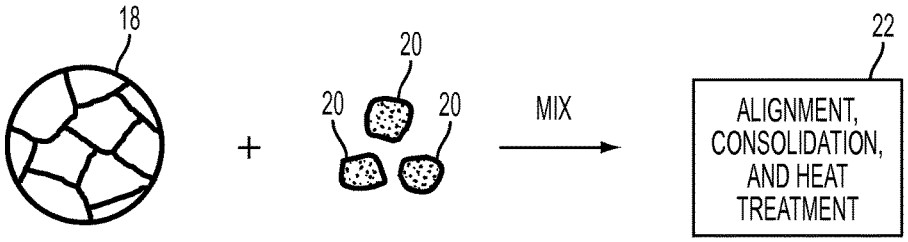
FIG. 7 is a schematic flowchart of a method of forming a magnet from Nd—Fe—B alloy and low melting point (LMP) powders, according to an embodiment.

With reference to FIG. 7, after the Nd—Fe—B alloy particles 18 have been prepared, such as by HDDR and jet milling, they may be mixed with the LMP alloy particles 20 to form a magnetic powder mixture. The powders may be mixed using any suitable method, such as using a powder mixer or by low energy ball milling of the mixture. The composition of the magnetic powder mixture may be varied according to the desired properties of the final magnet. For a magnet with a high energy product and remanence, the LMP alloy content may be kept relatively low. In one embodiment, the LMP alloy content may be from 0.1 wt. % to 10 wt. %, or any sub-range therein. For example, the LMP alloy content may be from 0.1 wt. % to 7.5 wt. %, 0.1 wt. % to 5 wt. %, or 1 wt. % to 5 wt. %. If high thermal stability is the primary goal, the magnet may have a relatively high LMP alloy content, such as at least 2.5 wt. %, 5 wt. %, 7.5 wt. % or 10 wt. %.

After the Nd—Fe—B alloy and LMP alloy powders are mixed, they may be aligned, consolidated, and optionally heat treated to form a bulk magnet at step 22. Due to the small particle sizes of the Nd—Fe—B powder (and LMP alloy powder, in some embodiments), conventional high-temperature sintering may not be a viable option. During high-temperature sintering, significant grain growth occurs, which eliminates the benefits of preparing the fine-grained powder and leads to poor properties (e.g., reduced coercivity). Accordingly, the powder mixture may be consolidated using techniques in which significant grain growth does not occur. Non-limiting examples of suitable consolidation techniques include spark plasma sintering (SPS), hot compaction, and microwave sintering. To consolidate the powder while also preventing grain growth, SPS and hot compaction may be performed at a temperature from 450° C. to 800° C. Microwave sintering promotes interparticular diffusion, and may therefore be carried out at temperatures lower than traditional sintering (which is generally about 1,000° C. to 1,070° C.). A magnetic field may be applied to the powder prior to and/or during the consolidation process in order to align the magnetic particles and form an anisotropic magnet.

After the consolidation process, an additional heat treatment may be performed to further improve the magnetic properties of the magnet, such as the coercivity, though additional diffusion. While the consolidation process primarily promotes higher density and better mechanical properties, the annealing process may primarily improve the magnetic properties, especially the coercivity. This heat treatment may be carried out at a temperature of 450° C. to 700° C. for a time sufficient to allow the desired degree of diffusion, generally less than 4 hours, depending on the LMP alloy chosen. During the consolidation process and/or the subsequent heat treatment, the LMP alloy may diffuse to the grain boundaries of the magnet. This may be due to the LMP alloy being at a temperature that is closer to its melting point, compared to the Nd—Fe—B alloy, resulting in a higher diffusion rate. If the LMP alloy includes a transition metal, these elements may be more stable than the rare earth elements, which may increase the corrosion resistance of the magnet.

Instead of, or in addition to, mixing the LMP alloy powder with the Nd—Fe—B alloy powder and consolidating the mixed powder into a bulk magnet, the LMP alloy may be incorporated into the magnet after it has been consolidated. The Nd—Fe—B alloy powder may be consolidated as described above (e.g., by SPS, hot compaction, microwave sintering) and the LMP alloy may be diffused into the magnet during a subsequent heat treatment, such as the 450° C. to 700° C. heat treatment described above. The LMP alloy may be in powder form, as described above, and may be spread onto or otherwise applied to the magnet prior to the heat treatment. Alternatively, the LMP alloy may be applied to the magnet as film, such a thin film, by a chemical or physical deposition method. During the heat treatment, the LMP alloy may then diffuse into the magnet and wet the grain boundaries, resulting in a similar effect as described for the mixed-powder embodiments. The heat treatment temperature and time may vary depending on factors such as the type of LMP alloy, the size/shape of the bulk magnet, the desired LMP alloy content in the magnet, or others.

Therefore, in both processes, the final magnet may have a higher concentration of the LMP alloy at the grain boundaries (e.g., intergranular composition) than in a bulk of the magnet (e.g., within the grains, or intragranular composition). Similarly, since the LMP alloy may dilute the iron concentration in the grain boundaries, the final magnet may have a lower concentration of iron at the grain boundaries (e.g., intergranular composition) than in a bulk of the magnet (e.g., within the grains, or intragranular composition). The disclosed processes therefore address one of the problems of as-formed HDDR powders, which have higher iron content in the grain boundaries compared to conventional sintered magnets.

Accordingly, in the present disclosure, permanent magnets having both refined grain sizes (e.g., less than one micron), improved texture, and the addition of LMP alloys are disclosed, as well as methods of forming the magnets. The small grains have very high anisotropy and good hysteresis loop "squareness," addressing the problems encountered with powders processed by HDDR alone. In addition, the LMP alloy improves the coercivity of the magnet so that the magnet can be used at elevated temperatures. The inclusion of the LMP alloy makes the addition of HREs unnecessary, resulting in a higher remanence and energy product for the magnet. However, if very high coercivity is desired, HREs may be incorporated into the magnet using methods known to those of ordinary skill in the art. Accordingly, the disclosed magnets have improved coercivity and remanence at high temperatures, making them suitable for applications such as electric vehicles and wind turbines.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a magnet, comprising:

pulverizing a magnetic powder of a Nd—Fe—B alloy, having a mean grain size of 100 to 500 nm, to a mean particle size of 100 nm to 10 μm; and mixing the pulverized magnetic powder with a non-magnetic low melting point (LMP) alloy powder having a melting point from 400° C. to 600° C. and a mean particle size of 100 nm to 900 nm to form a powder mixture.

2. The method of claim 1, further comprising a hydrogenation disproportionation desorption and recombination (HDDR) prior to the pulverizing step.

3. The method of claim 1, wherein the pulverizing step includes jet milling.

4. The method of claim 1, wherein the LMP alloy consists of a rare earth element and one of Cu, Ga, and Al.

5. The method of claim 1, further comprising consolidating the powder mixture to form a bulk magnet, wherein the consolidating step includes microwave sintering.

6. The method of claim 5, further comprising a heat treatment step after the consolidating step, wherein the heat treatment is performed at a temperature of 450° C. to 700° C.

7. The method of claim 1, wherein the pulverized magnetic powder has a mean particle size of 1.1 μm to 2.9 μm.

* * * * *